US010144982B2

(12) United States Patent
Lee et al.

(10) Patent No.: US 10,144,982 B2
(45) Date of Patent: Dec. 4, 2018

(54) FE—MN—C-BASED TWIP STEEL HAVING REMARKABLE MECHANICAL PERFORMANCE AT VERY LOW TEMPERATURE, AND PREPARATION METHOD THEREOF

(75) Inventors: Tae Kyung Lee, Pohang-si (KR); Chong Soo Lee, Pohang-si (KR); Seok Weon Song, Pohang-si (KR); Jae Hyung Kim, Pohang-si (KR); Kaneaki Tsuzaki, Fukuoka (JP); Motomichi Koyama, Fukuoka (JP)

(73) Assignee: POSTECH ACADEMY-INDUSTRY FOUNDATION, Pohang-si, Gyeongnsangbuk-Do (KR)

( * ) Notice: Subject to any disclaimer, the term of this patent is extended or adjusted under 35 U.S.C. 154(b) by 912 days.

(21) Appl. No.: 14/399,515

(22) PCT Filed: Aug. 17, 2012

(86) PCT No.: PCT/KR2012/006567

§ 371 (c)(1),
(2), (4) Date: Nov. 7, 2014

(87) PCT Pub. No.: WO2013/172510

PCT Pub. Date: Nov. 21, 2013

(65) Prior Publication Data

US 2015/0114526 A1 Apr. 30, 2015

(30) Foreign Application Priority Data

May 14, 2012 (KR) ..... 10-2012-0050716

(51) Int. Cl.

| | |
|---|---|
| ***C21D 8/00*** | (2006.01) |
| ***C22C 38/04*** | (2006.01) |
| ***C21D 6/00*** | (2006.01) |
| ***C21D 8/02*** | (2006.01) |
| ***C21D 8/06*** | (2006.01) |

(52) U.S. Cl.

CPC ..... *C21D 8/005* (2013.01); *C21D 6/005* (2013.01); *C21D 8/0231* (2013.01); *C21D 8/065* (2013.01); *C22C 38/04* (2013.01); *C21D 8/0236* (2013.01); *C21D 2201/03* (2013.01); *C21D 2201/05* (2013.01); *C21D 2211/001* (2013.01); *C21D 2211/005* (2013.01)

(58) Field of Classification Search

CPC ..... C21D 8/005

See application file for complete search history.

(56) References Cited

U.S. PATENT DOCUMENTS

| | | | | |
|---|---|---|---|---|
| 2009/0010793 | A1 | 1/2009 | Becker et al. | |
| 2010/0012233 | A1 | 1/2010 | Hong | |
| 2010/0051146 | A1 | 3/2010 | Park et al. | |
| 2012/0128524 | A1 * | 5/2012 | Chun | C21D 6/005 420/72 |

FOREIGN PATENT DOCUMENTS

| | | | |
|---|---|---|---|
| KR | 10-2010-0009222 | A | 1/2010 |
| KR | 10-2010-0028310 | A | 3/2010 |
| KR | 10-2011-0115651 | A | 10/2011 |

OTHER PUBLICATIONS

Oh, Y. S., Son, I. H., Jung, K. H., Kim, D. K., Lee, D. L., & Im, Y. T. (2011). Effect of initial microstructure on mechanical properties in warm caliber rolling of high carbon steel. Materials Science and Engineering: A, 528(18), 5833-5839.*

* cited by examiner

*Primary Examiner* — Jessee R Roe
*Assistant Examiner* — Jophy S. Koshy
(74) *Attorney, Agent, or Firm* — Revolution IP, PLLC

(57) ABSTRACT

Provided is a Fe—Mn—C-based twinning-induced plasticity (TWIP) steel which includes 13 wt % to 24 wt % of manganese (Mn), 0.4 wt % to 1.2 wt % of carbon (C), and iron (Fe) as well as other unavoidable impurities as a remainder, is manufactured by caliber rolling, has a microstructure including elongated grains that are elongated in a rolling direction, and has an average grain size of the elongated grains in a direction perpendicular to the rolling direction of 1 μm or less.

9 Claims, 2 Drawing Sheets

FE—MN—C-BASED TWIP STEEL HAVING REMARKABLE MECHANICAL PERFORMANCE AT VERY LOW TEMPERATURE, AND PREPARATION METHOD THEREOF

CROSS REFERENCE TO PRIOR APPLICATIONS

This application is a National Stage Application of PCT International Patent Application No. PCT/KR2012/006567 filed on Aug. 17, 2012, under 35 U.S.C. § 371, which claims priority to Korean Patent Application No. 10-2012-0050716 filed on May 14, 2012, which are all hereby incorporated by reference in their entirety.

TECHNICAL FIELD

The present invention relates to a Fe—Mn—C-based twinning-induced plasticity steel (hereinafter, referred to as "TWIP" steel) having excellent mechanical performance at an ultra-low temperature of −100° C. or less as well as at room temperature and a method of manufacturing the same, and more particularly, to a TWIP steel having excellent strength and ductility at an ultra-low temperature range of −196° C. to −100° C. by microstructurally having an ultra-fine elongated grain structure and a method of manufacturing a TWIP steel having excellent industrial utilization by which the above TWIP may be mass-produced in the shape of a bulk rod.

BACKGROUND ART

TWIP steels may have a stable austenite single phase at room temperature by containing a large amount of manganese and may prevent the movement of dislocations by generating mechanical twins in austenite grains during plastic deformation to be further work hardened. Thus, excellent elongation may be obtained. Since TWIP steels may obtain high tensile strength as well as high elongation, the TWIP steels are materials that may be used as various structural materials.

In particular, ductility of typical ferritic steels may be significantly reduced at a low temperature range, and the reason for this is that when the temperature is decreased to a low temperature range, yield strength rapidly increases to cause brittle fracture.

In contrast, with respect to austenite steels including TWIP steels, since the strength at a low temperature does not rapidly increase as much as that of the ferritic steel, a ductile-brittle transition temperature is generally lower. Thus, the austenite steels including TWIP steels may have potential to be used as a low temperature or ultra-low temperature material.

As a prior art document, Korean Patent No. 1127632 discloses a method of manufacturing a steel strip or steel sheet, as a TWIP steel having excellent ductility at a low temperature, which contains 1.00 wt % or less of carbon (C), 7.00 wt % to 30.00 wt % of manganese (Mn), 1.00 wt % to 10.00 wt % of aluminum (Al), greater than 2.50 wt % and equal to or less than 8.00 wt % of silicon (Si), greater than 3.50 wt % and equal to or less than 12.00 wt % of Al+Si, less than 0.01 wt % of boron (B), less than 8.00 wt % of nickel (Ni), less than 3.00 wt % of copper (Cu), less than 0.60 wt % of nitrogen (N), less than 0.30 wt % of niobium (Nb), less than 0.30 wt % of titanium (Ti), less than 0.30 wt % of vanadium (V), less than 0.01 wt % of phosphorus (P), and iron (Fe) as well as other unavoidable impurities as a remainder. However, the TRIP steel manufactured by this method are only manufactured in the shape of a strip, and also, excellent ductility at an ultra-low temperature of −100° C. or less may not be realized.

Also, Korean Patent Application Laid-Open Publication No. 2001-107473 discloses a TWIP steel including 0.5 wt % to 1.0 wt % of carbon, 10 wt % to 20 wt % of manganese, 4.0 wt % or less of chromium, 0.02 wt % to 0.3 wt % of nitrogen, and iron as well as other unavoidable impurities as a remainder. The above publication is related to the TWIP steel in the shape of a plate and a method of manufacturing the same, and excellent mechanical properties at an ultra-low temperature may also be difficult to be realized in the above alloy.

DISCLOSURE OF THE INVENTION

Technical Problem

The purpose of the present invention is to provide a TWIP steel which may be particularly suitable for extreme environment of an ultra-low temperature, because excellent mechanical properties may be realized at an ultra-low temperature as well as at room temperature.

The purpose of the present invention is also to provide a method of manufacturing a TWIP steel by which the TWIP steel having excellent mechanical properties at an ultra-low temperature may be mass-produced in the shape of a bulk rod.

Technical Solution

According to an embodiment of the present invention, there is provided a twinning-induced plasticity (TWIP) steel having excellent mechanical properties at an ultra-low temperature, characterized in that the TWIP steel includes 13 wt % to 24 wt % of manganese (Mn), 0.4 wt % to 1.2 wt % of carbon (C), and iron (Fe) as well as other unavoidable impurities as a remainder, is manufactured by caliber rolling, has a microstructure including elongated grains that are elongated in a rolling direction, and has an average grain size of the elongated grains in a direction perpendicular to the rolling direction of 1 μm or less.

The average grain size of the elongated grains in the direction perpendicular to the rolling direction may be 0.5 μm or less.

The TWIP steel according to the present invention may have a yield strength of 1,000 MPa or more, a tensile strength of 1,600 MPa or more, and an elongation of 20% or more at −160° C.

Also, the TWIP steel according to the present invention may have a product of tensile strength and uniform elongation of 40,000 MPa % or more at −160° C.

According to another embodiment of the present invention, there is provided a method of manufacturing a twinning-induced plasticity (TWIP) steel having excellent mechanical properties at an ultra-low temperature including the steps of: (a) processing an alloy including 13 wt % to 24 wt % of manganese (Mn), 0.4 wt % to 1.2 wt % of carbon (C), and iron (Fe) as well as other unavoidable impurities as a remainder into a caliber-rollable form; (b) water-cooling after heating the processed alloy to 700° C. to 1100° C. for 30 minutes to 5 hours; and (c) caliber rolling after heating the water-cooled alloy to 400° C. to 550° C. for 30 minutes to 5 hours, wherein the caliber rolling is performed at a reduction of area of 80% or more.

In the manufacturing method according to the present invention, the heating in the step (b) may be performed for 30 minutes to 2 hours.

In the manufacturing method according to the present invention, the heating in the step (C) may be performed for 30 minutes to 2 hours.

In the manufacturing method according to the present invention, the reduction of area of 80% or more in the step (C) may be achieved through 6 to 12 passes.

In the manufacturing method according to the present invention, the TWIP steel may be formed in a shape of a rod.

In the manufacturing method according to the present invention, a microstructure of the TWIP steel may include elongated grains that are elongated in a rolling direction, and an average grain size of the elongated grains in a direction perpendicular to the rolling direction may be 1 μm or less, for example, 0.5 μm or less.

In the manufacturing method according to the present invention, the TWIP steel may have a yield strength of 1,000 MPa or more, a tensile strength of 1,600 MPa or more, and an elongation of 20% or more at −160° C.

In the manufacturing method according to the present invention, the TWIP steel may have a product of tensile strength and uniform elongation of 40,000 MPa % or more at −160° C.

Advantageous Effects

With respect to a TRIP steel manufactured according to a method of the present invention, strength in an ultra-low temperature range may be improved and the loss of ductility may be minimized by applying multi-pass caliber rolling as a severe plastic deformation to form an ultrafine elongated grain structure and preventing ε-martensites and annealing twins through the ultrafine elongated grain structure. Thus, excellent mechanical properties at an ultra-low temperature may be realized.

Also, the final shape of the TWIP steel may be manufactured not in the shape of a plate but in the shape of a rod through caliber rolling, and a cross-sectional diameter and a length may be freely controlled and mass production may be possible due to the nature of the process. Therefore, the industrial utilization value of the TWIP steel may be very high.

MODE FOR CARRYING OUT THE INVENTION

Figure 1:
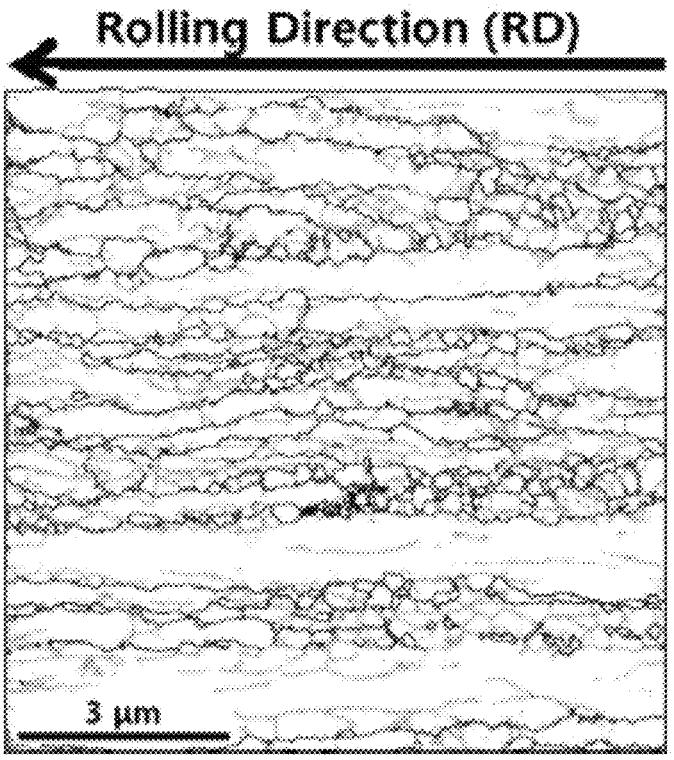
FIG. 1 illustrates grain boundaries of a TWIP steel manufactured according to an embodiment of the present invention.

Hereinafter, the present invention will be described in detail by dividing into a TWIP steel and a method of manufacturing the TWIP steel.

[TWIP Steel]

The terms used in the present invention will be defined before the detailed description of embodiments of the present invention.

The expression "elongated grain" in the present invention denotes a grain elongated in a rolling direction of caliber rolling, in which an aspect ratio of the grain is 2 or more, may be 10 or more, and for example, may be 20 or more.

Also, the expression "elongated grain structure" denotes that, in a microstructure subjected to caliber rolling, a ratio of the above-defined "elongated grain" to a total area of the microstructure is at least 80% or more.

Furthermore, the expression "average gain size" denotes an average distance between high-angle grain boundaries in a direction perpendicular to the rolling direction of caliber rolling.

A TWIP steel according to the present invention may include 13 wt % to 24 wt % of manganese (Mn), 0.4 wt % to 1.2 wt % of carbon (C), and iron (Fe) as well as other unavoidable impurities as a remainder, may have a microstructure including elongated grains that are elongated in a rolling direction, and may have an average grain size of the elongated grains in a direction perpendicular to the rolling direction of 1 μm or less.

The above composition is designed to increase basic tensile performance of a material by decreasing stacking fault energy, and the reason for limiting amounts of specific components will be described.

Mn: 13 to 24 wt %

Mn, as a solid solution strengthening element in steel, may contribute to the stabilization of austenite. When an amount of Mn is less than 13 wt % or greater than 24 wt %, stacking fault energy may be excessively high to inhibit a twinning-induced plasticity effect. Therefore, the amount of Mn may be limited to a range of 13 wt % to 24 wt %. For example, the amount of Mn may be limited to a range of 16 wt % to 18 wt %.

C: 0.4 to 1.2 wt %

C may contribute to the stabilization of austenite. In the case that an amount of C is less than 0.4 wt %, ε-martensite transformation may occur to adversely affect physical properties. In the case in which the amount of C is greater than 1.2 wt %, stacking fault energy may be excessively high to inhibit the twinning-induced plasticity effect. Therefore, the amount of C may be limited to a range of 0.4 wt % to 1.2 wt %. For example, the amount of C may be limited to a range of 0.5 wt % to 0.9 wt %.

Unavoidable Impurities

Impurities, such as silicon (Si), aluminum (Al), nitrogen (N), and sulfur (S), may be added during a manufacturing process, and the maximum allowable amount of the impurities may be limited to 0.1 wt % or less.

In the TWIP steel, the average grain size of the elongated grains in the direction perpendicular to the rolling direction may be 1 μm or less. When the average grain size of the elongated grains in the direction perpendicular to the rolling direction is greater than 1 μm, excellent mechanical properties at an ultra-low temperature may not be realized. For example, the average grain size may be 0.5 μm or less.

[Method of Manufacturing TWIP Steel]

A method of manufacturing a TWIP steel according to the present invention may include the steps of: billet processing in which an alloy including 13 wt % to 24 wt % of Mn, 0.4 wt % to 1.2 wt % of C, and Fe as well as other unavoidable impurities as a remainder is processed into a caliber-rollable form, for example, a billet; performing a homogenization treatment in which the processed billet is heated to 700° C. to 1100° C. for 30 minutes to 5 hours and then water-cooled; heating before processing in which the homogenized billet is heated to 400° C. to 550° C. for 30 minutes to 5 hours; and caliber rolling.

The billet processing is a step of processing the alloy into the form that may be processed by a caliber rolling mill, in which an alloy is melted and then processed from an ingot into the form of a billet through a casting process, and a known method may be used.

The performing of the homogenization treatment is a step of homogenizing a microstructure of the billet by a heat treatment. In this case, it is important to prevent the precipitation of carbides that may adversely affect mechanical properties of a final product. In the case that a heat treatment temperature is less than 700° C., carbides are precipitated to adversely affect physical properties, and in the case in which the heat treatment temperature is greater than 1100° C., economic loss is high. Therefore, the heat treatment temperature may be in a range of 700° C. to 1100° C. Also, in the case that a heat treatment time is less than 30 minutes, it may not be sufficient to perform a uniform heat treatment on the entire material. In the case in which the heat treatment time is greater than 5 hours, economic loss is high. Thus, the heat treatment time may be in a range of 30 minutes to 5 hours. For example, the heat treatment time may be in a range of 30 minutes to 2 hours.

The heating before processing is a step for facilitating caliber rolling and obtaining a desired microstructure. In the case that a heating temperature is less than 400° C., processability of the caliber rolling may be significantly reduced. In the case in which the heating temperature is greater than 550° C., since dynamic precipitation may occur during the caliber rolling, the mechanical properties of the final product may be deteriorated. Therefore, the heating temperature before the caliber rolling may be in a range of 400° C. to 550° C. Also, in the case that a heating time is less than 30 minutes, it may not be sufficient to uniformly heat the entire material. In the case in which the heating time is greater than 5 hours, economic loss is high. Thus, the heating time may be in a range of 30 minutes to 5 hours. For example, the heating time may be in a range of 30 minutes to 2 hours.

In the manufacturing method according to the present invention, a reduction of area during the caliber rolling may be 80% or more. The reason for this is that, in the case that the reduction of area is less than 80%, it may not be sufficient to obtain the microstructure having elongated grains according to the present invention.

Also, the reduction of area of 80% or more may be achieved through 6 to 12 passes. In the case that less than 6 passes are performed, since an amount of rolling may be excessively high, defects may occur in the material. In the case in which greater than 12 passes are performed, economic loss is high.

Example

Hereinafter, a specific example of the present invention will be described.

A melt of an alloy including 17 wt % of Mn, 0.6 wt % of C, and Fe as a remainder was prepared and then casted to process into a billet in the form of a square column having a width of 30 mm and a length of 500 mm.

Subsequently, the billet was put in a heat treatment furnace and heated to 1,000° C. The temperature was held for 1 hour, and the billet was then water-cooled.

The water-cooled billet was heated to 500° C. and held for 1 hour. Then, severe plastic deformation was performed by using a multi-pass caliber rolling mill. In this case, the multi-pass caliber rolling mill was designed to achieve a cumulative reduction of area of 80% through a total of 8 passes.

Specific processes of the caliber rolling are as follows:

The billet heated to 500° C. was taken out from the furnace and continuously rolled up to 8 passes at room temperature using the caliber rolling mill. In this case, the rolling was performed while rotating the material by 90 degrees in a clockwise direction for each pass. For example, the material was rotated by 90 degrees in the clockwise direction after first pass rolling and second pass rolling was then performed. Thereafter, the material was again rotated by 90 degrees in the clockwise direction (total 180 degrees rotation) to perform third pass rolling.

FIG. 1 illustrates grain boundaries obtained by performing an electron backscatter diffraction (EBSD) analysis on a microstructure of a rod manufactured according to the above method. In FIG. 1, a black line denotes a high-angle gain boundary and a green line denotes a low-angle grain boundary. As illustrated in FIG. 1, it may be understood that the TWIP steel rod manufactured according to the example of the present invention had an elongated grain structure, in which grains were elongated in a rolling direction and had an aspect ratio of greater than 20 based on the high-angle gain boundary.

In FIG. 1, it was identified that a measured average distance between the high-angle grain boundaries in a direction perpendicular to the caliber rolling direction was about 460 nm. It may be understood that the ultrafine elongated grain structure was formed by the manufacturing method according to the example of the present invention.

Comparative Example

The preparation of comparative materials was performed as follows: A material having the same composition was hot-rolled at 1,000° C. to process into a 25 mm thick plate. Then, the plate was introduced into a heat treatment furnace, again heated to 1,000° C., held for 1 hour, and then water-cooled. The water-cooled plate was cold-rolled to achieve a reduction of area of 60%. Then, the cold-rolled plates were respectively heat treated at 700° C., 800° C., 900° C., and 1,000° C. for 30 minutes and then water-cooled. In this case, it was identified that average grain sizes of the corresponding materials were 3.5 μm, 10 μm, 23 μm, and 37 μm, respectively.

The following Table 1 illustrates the results of tensile tests performed at room temperature (RT) and an ultra-low temperature (−150° C.)

TABLE 1

| | | Tensile Properties | | | | | | | |
|---|---|---|---|---|---|---|---|---|---|
| | | Room temperature (RT) | | | | Ultra-low temperature (−150° C.) | | | |
| Specimen | Grain size (μm) | Yield strength (MPa) | Tensile strength (MPa) | Uniform elongation (%) | Rm-A (MPa %) | Yield strength (MPa) | Tensile strength (MPa) | Uniform elongation (%) | Rm-A (MPa %) |
| Example 1 | 0.46 | 840 | 1280 | 40 | 51200 | 1100 | 1700 | 29 | 49300 |
| Comparative Example 1 | 3.5 | 410 | 1120 | 55 | 61600 | 500 | 1360 | 27 | 36720 |
| Comparative Example 2 | 10.4 | 340 | 1080 | 65 | 70200 | 390 | 1200 | 21 | 25200 |

TABLE 1-continued

| | | Tensile Properties | | | | | | | |
|---|---|---|---|---|---|---|---|---|---|
| | | Room temperature (RT) | | | | Ultra-low temperature (−150° C.) | | | |
| Specimen | Grain size (μm) | Yield strength (MPa) | Tensile strength (MPa) | Uniform elongation (%) | Rm-A (MPa %) | Yield strength (MPa) | Tensile strength (MPa) | Uniform elongation (%) | Rm-A (MPa %) |
| Comparative Example 3 | 22.8 | 290 | 1020 | 62 | 63240 | 350 | 1050 | 16 | 16800 |
| Comparative Example 4 | 37.2 | 280 | 980 | 64 | 62720 | 340 | 910 | 12 | 10920 |

Figure 2:
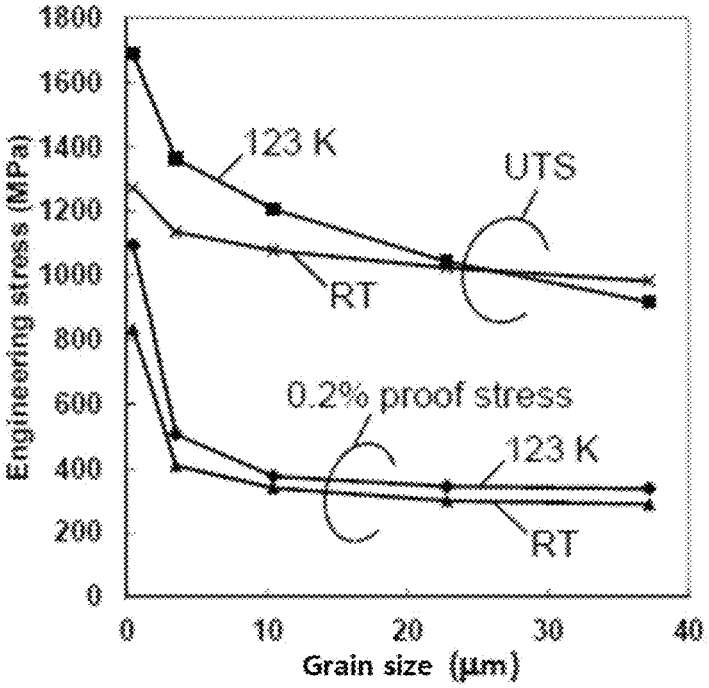
FIG. 2 illustrates yield strengths and tensile strengths of TWIP steels according to example and comparative examples of the present invention which are measured at room temperature (RT) and an ultra-low temperature (−150° C.)
Figure 4:
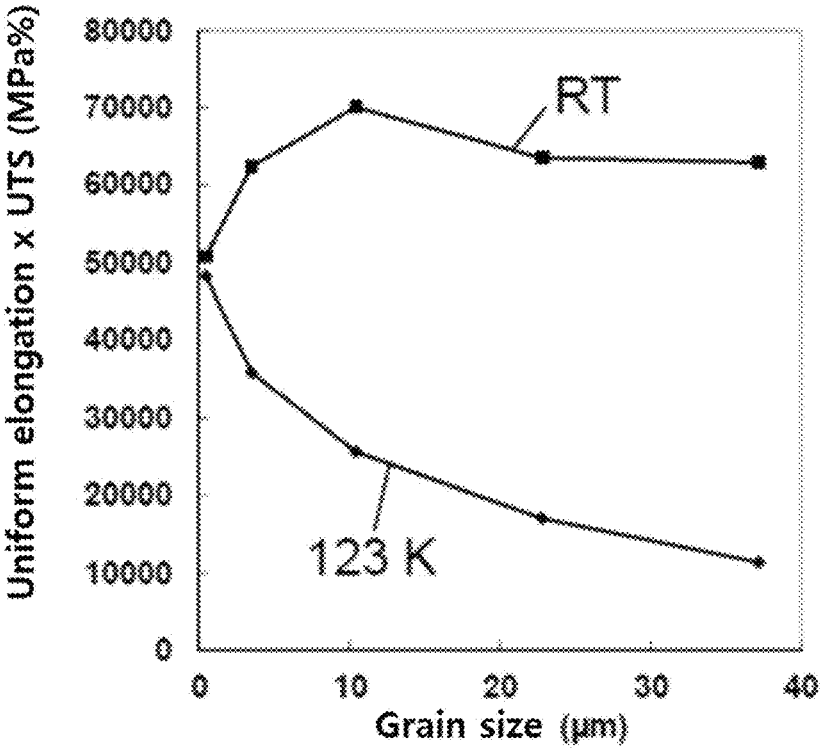
FIG. 4 illustrates the results of products of uniform elongations and tensile strengths of the TWIP steels according to the example and comparative examples of the present invention.

FIG. 2 illustrates yield strengths and tensile strengths of TWIP steels according to example and comparative examples of the present invention which are measured at room temperature (RT) and an ultra-low temperature (−150° C.), FIG. illustrates uniform elongations of the TWIP steels according to the example and comparative examples of the present invention which are measured at room temperature (RT) and an ultra-low temperature (−150° C.), and FIG. 4 illustrates the results of products of uniform elongations and tensile strengths of the TWIP steels according to the example and comparative examples of the present invention.

As illustrated in Table 1 and FIG. 2, with respect to yield strength (0.2 proof stress) and tensile strength (ultimate tensile strength (UTS)), the yield strengths and tensile strengths at both room temperature and ultra-low temperature increased as the grain size decreased, and values of the yield strength and tensile strength at an ultra-low temperature were higher than those of the yield strength and tensile strength at room temperature.

Figure 3:
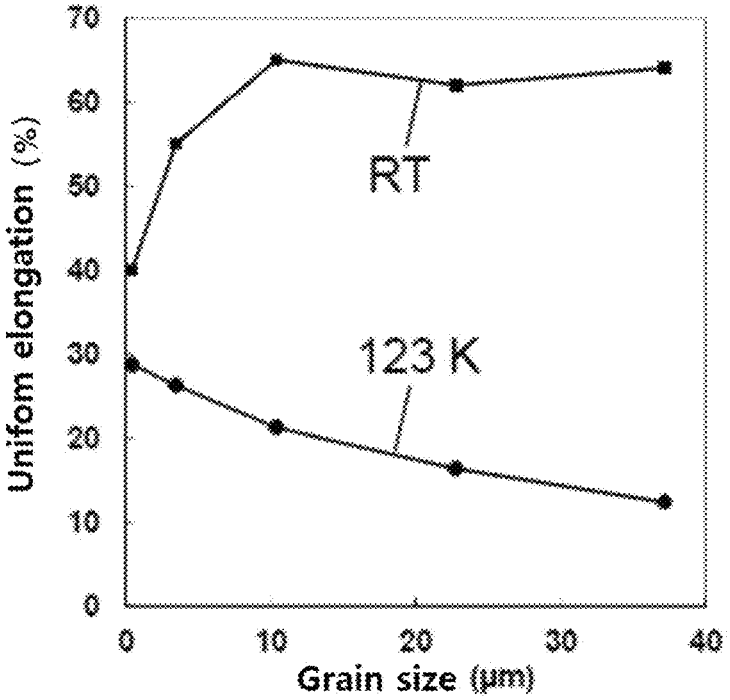
FIG. 3 illustrates uniform elongations of the TWIP steels according to the example and comparative examples of the present invention which are measured at room temperature (RT) and an ultra-low temperature (−150° C.)

As illustrated in Table 1 and FIG. 3, with respect to elongation, the specimens exhibited a general trend in tensile tests at room temperature, in which the elongation decreased inversely proportional to the increase in the strength as the grain size decreased. However, since the grain size decreased at an ultra-low temperature of −150° C., an opposite phenomenon may appear in which the elongation increased despite of the increase in the strength.

Accordingly, when a value of the product of tensile strength and uniform elongation (value referred to as "ECO index" or "Rm-A"), a factor representing mechanical properties of a TWIP steel, was plotted with respect to the grain size, the value was about 50,000 MPa % in the case that the grain size was less than 1 μm as illustrated in FIG. 4. Thus, it may be understood that when compared with a maximum value obtainable at room temperature of about 70,000 MPa %, mechanical properties, such as about 70% of the maximum value at room temperature, may be realized. In particular, since a high elongation of about 30% was obtained at an ultra-low temperature, the TWIP steel according to the present invention may be suitable for an ultra-low temperature environment.

The invention claimed is:

1. A method of manufacturing a twinning-induced plasticity (TWIP) steel, the method comprising the steps of:

(a) processing an alloy including 13 wt % to 24 wt % of manganese (Mn), 0.4 wt % to 1.2 wt % of carbon (C), and iron (Fe) as well as other unavoidable impurities as a remainder into a form capable of caliber rolling;

(b) heating the processed alloy to 700° C. to 1100° C. for 30 minutes to 5 hours, and then water-cooling the heated alloy; and (c) heating the water-cooled alloy to 400° C. to 550° C. for 30 minutes to 5 hours, and then caliber rolling the heated alloy, wherein the caliber rolling is performed at a reduction of area of 80% or more.

2. The method of claim 1, wherein the heating in the step (b) is performed for 30 minutes to 2 hours.

3. The method of claim 1, wherein the heating in the step (c) is performed for 30 minutes to 2 hours.

4. The method of claim 1, wherein the reduction of area is achieved through 6 to 12 passes.

5. The method of claim 1, wherein the TWIP steel is formed in a shape of a rod through the caliber rolling.

6. The method of claim 1, wherein a microstructure of the TWIP steel comprises elongated grains that are elongated in a rolling direction, and an average grain size of the elongated grains in a direction perpendicular to the rolling direction is 1 μm or less.

7. The method of claim 1, wherein the microstructure of the TWIP steel comprises elongated grains that are elongated in the rolling direction, and the average grain size of the elongated grains in the direction perpendicular to the rolling direction is 0.5 μm or less.

8. The method of claim 1, wherein, when temperature is at −160° C., the TWIP steel has a yield strength of 1,000 MPa or more, a tensile strength of 1,600 MPa or more, and an elongation of 20% or more.

9. The method of claim 1, wherein the TWIP steel has a product of tensile strength and total elongation of 40,000 MPa % or more at −160° C.

* * * * *